US009290245B2

(12) United States Patent
Bishop

(10) Patent No.: US 9,290,245 B2
(45) Date of Patent: Mar. 22, 2016

(54) STAND-UP PADDLE BOARD TRACTION PAD WITH INTEGRATED SEAT

(71) Applicant: Josh Bishop, Putnam Valley, NY (US)

(72) Inventor: Josh Bishop, Putnam Valley, NY (US)

( * ) Notice: Subject to any disclaimer, the term of this patent is extended or adjusted under 35 U.S.C. 154(b) by 24 days.

(21) Appl. No.: 14/475,895

(22) Filed: Sep. 3, 2014

(65) Prior Publication Data

US 2015/0059638 A1 Mar. 5, 2015

Related U.S. Application Data

(60) Provisional application No. 61/873,042, filed on Sep. 3, 2013.

(51) Int. Cl.
*B63B 35/83* (2006.01)
*B63B 35/85* (2006.01)
*B63B 35/79* (2006.01)

(52) U.S. Cl.
CPC ..... *B63B 35/85* (2013.01); *B63B 35/79* (2013.01)

(58) Field of Classification Search
CPC ..... B63B 35/79; B63B 35/85
USPC ..... 114/362–364; 441/65, 72, 74, 77, 79
See application file for complete search history.

(56) References Cited

U.S. PATENT DOCUMENTS 5,766,051 A * 6/1998 Messer ..... A63C 5/00 441/65
8,590,478 B2 * 11/2013 Lipman ..... B63B 35/71 114/347
2007/0054573 A1 * 3/2007 Skedeleski ..... B63B 35/7936 441/65
2007/0218714 A1 * 9/2007 Shaw ..... A43B 1/0081 439/73

* cited by examiner

*Primary Examiner* — Daniel V Venne

(57) ABSTRACT

A traction pad system for use on a stand-up paddleboard contains an integrated seat feature that may be easily raised by the user at any desired time. The system includes a paddleboard mounting pad, a seat, a bracing mechanism, and an adhesive. The paddleboard mounting pad contains a seat-receiving hole, a first surface, and a second surface; the adhesive is superimposed over the second surface and is used to fasten the system to the top of a paddleboard. The seat fits inside the seat-receiving hole in a flush manner and is hingedly attached to the paddleboard mounting pad; the seat therefore does not interfere with the operations of the user when not in use. The seat is structurally supported by the bracing mechanism in the raised state.

20 Claims, 10 Drawing Sheets

STAND-UP PADDLE BOARD TRACTION PAD WITH INTEGRATED SEAT

The current application claims a priority to the U.S. Provisional Patent application Ser. No. 61/873,042 filed on Sep. 3, 2013.

FIELD OF THE INVENTION

The present invention relates generally to stand-up paddle boards. More specifically, the present invention is a traction pad for a stand-up paddle board that contains a deployably integrated back rest.

BACKGROUND OF THE INVENTION

Stand up paddle surfing refers to the water sport in which the user stands on an elongated surfboard and propels themselves forwards via a long shafted paddle. The sport is a derivative of paddleboarding which in turn stems from traditional surfing. Stand up paddle boarding is most often performed on an open and steady body of water such as the open region of the ocean, lakes, canals, and rivers. As the sport is characterized by standing, balancing, and paddling on a surfboard, the preferred environmental conditions are standing water, unbroken swells, and/or open bodies of water because it easier to keep balance in such conditions. More skilled paddlers take the sport to extremes by racing on large rivers and canals, traversing long distances along the sea coasts, and even riding breaking waves similar to traditional surfing. In recent years, this sport has become extremely popular with the general public due to its versatility and ease of use; the sport is substantially less demanding than traditional surfing and in result appeals to all age groups and body types.

A paddle board user can become easily exhausted from standing on a paddle board for the entire duration of use, whether the board is being used for training or for leisurely reasons. Currently there are no effective means to provide the paddle board user relief, to use only as needed, and retain the full functional ability of a stand up paddle board when not in use. It is therefore an object of the present invention to include an apparatus which provides a fold out back rest for the paddle board user to relax and rest on when tired, but also the ability for the back rest to collapse and allow the user full functional use of the stand-up paddle board as intended originally. The present invention is a paddle board traction pad which contains a discreetly stored seat rest. The user simply raises the seat to sit and relax and fold it away during the operations; the seat folds away in a flush manner such that it does not interfere with the user's foot placement and other similar board characteristics.

DETAILED DESCRIPTIONS OF THE INVENTION

All illustrations of the drawings are for the purpose of describing selected versions of the present invention and are not intended to limit the scope of the present invention.

Figure 7:
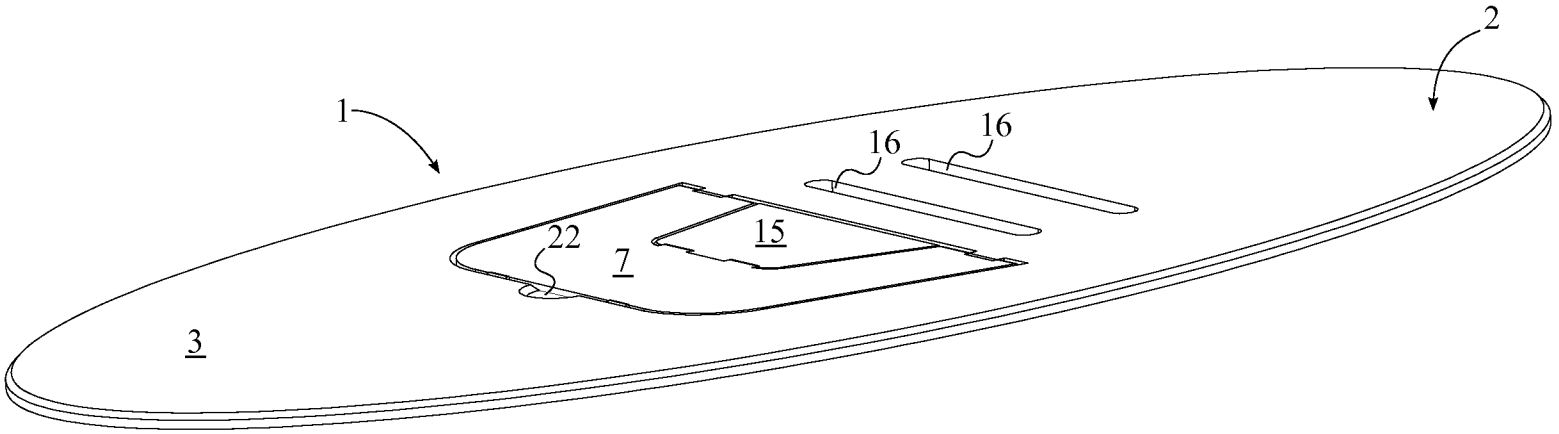
FIG. 7 is a perspective view of the present invention with the seat and the support strut in the folded down state.
Figure 8:
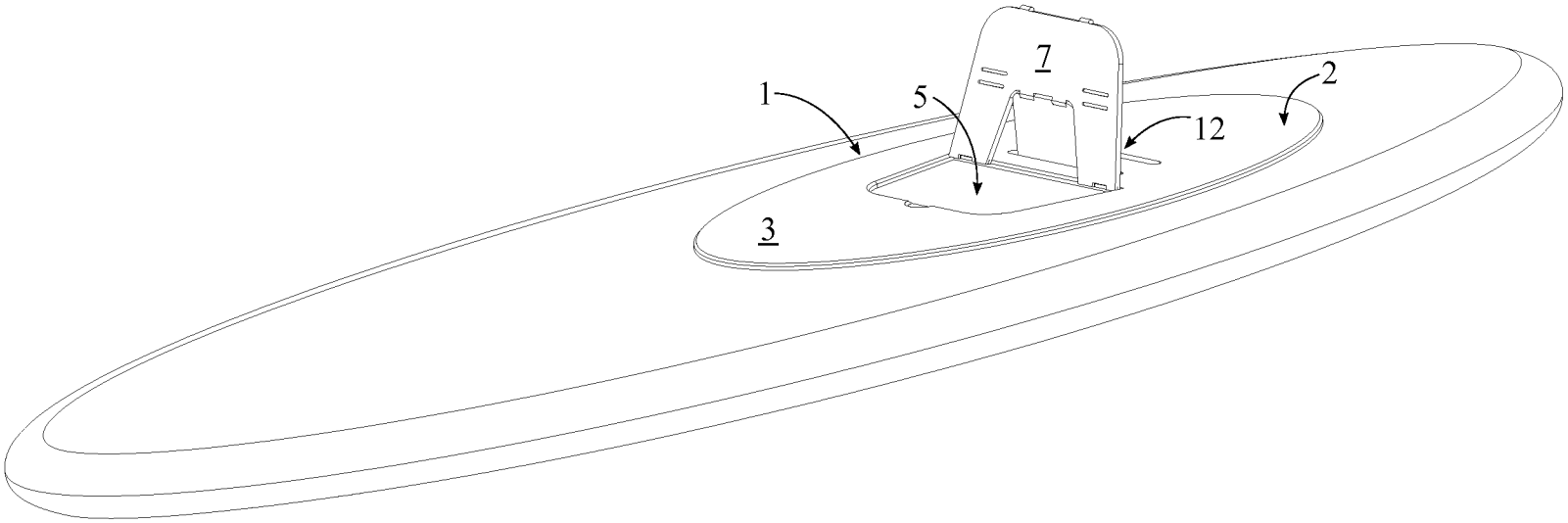
FIG. 8 is a perspective view of the present invention adhered to the top of a paddleboard.

As can be seen in FIG. 1 through FIG. 10, the present invention is a multi-functional traction pad for a paddleboard, preferably a stand up paddleboard. The present invention comprises a paddleboard mounting pad 1, a seat 7, a bracing mechanism 12, and an adhesive 6. The paddleboard mounting pad 1 provides the user with grip and traction to ensure maximum stability and control over the paddleboard. The seat 7 allows the user to sit and relax on the paddleboard whenever they please. The bracing mechanism 12 provides the structural support for the seat 7. The adhesive 6 fastens the present invention to the paddleboard. The paddleboard mounting pad 1 comprises an ellipsoid planar body 2 and a seat-receiving hole 5. The elliptical shape of the ellipsoid planar body 2 mimics traditional paddleboard designs to further increase the compatibility of the present invention with the majority of paddleboard designs available on the market as seen in FIG. 8. The ellipsoid planar body 2 comprises a top surface 3 and a bottom surface 4; the top surface 3 is exposed to the environment and directly engages the user during operations. The adhesive 6 is superimposed over the bottom surface 4 and used to attach the present invention to the top surface of the paddleboard. The present invention is preferably attached to the area of the paddleboard where the user spends the majority of the time; this is most often located towards the middle section of the rear as this area controls the paddleboard the most efficiently.

The top surface 3 and bottom surface 4 are separated by a certain amount of distance. In different embodiments of the present invention, the thickness, shape, and size of the paddleboard mounting pad 1 varies to accommodate various paddleboard designs, user needs, and user requirements. The preferred material composition for the paddleboard mounting pad 1 and the seat 7 is durable plastic, rubber composite. Alternative material compositions include, but are not limited to, foam, ethylene vinyl acetate, rubber, plastic, and other comparable materials.

The seat-receiving hole 5 traverses through the ellipsoid planar body 2 from the top surface 3 to the bottom surface 4. The seat 7 is positioned adjacent to the seat-receiving hole 5 and is hingedly connected to the ellipsoid planar body 2. Additionally, the seat 7 is bistably coupled to the ellipsoid planar body 2 by the bracing mechanism 12. The bistably coupling allows the seat 7 to be positioned into two states, a folded up state and a folded down state. The seat-receiving hole 5 is preferably shaped complimentary to the shape and design of the seat 7 such that the seat 7 may fold down and align with the top surface 3 in a flush manner as seen in FIG. 7. The ability for the seat 7 to fold down a flush manner with the top surface 3 is essential to the functionality of the present invention because this ensures that the seat 7 and the associated components do not interfere with the operations of the user when not in use, allowing the user to utilize the paddleboard to its fullest extent and potential.

Figure 1:
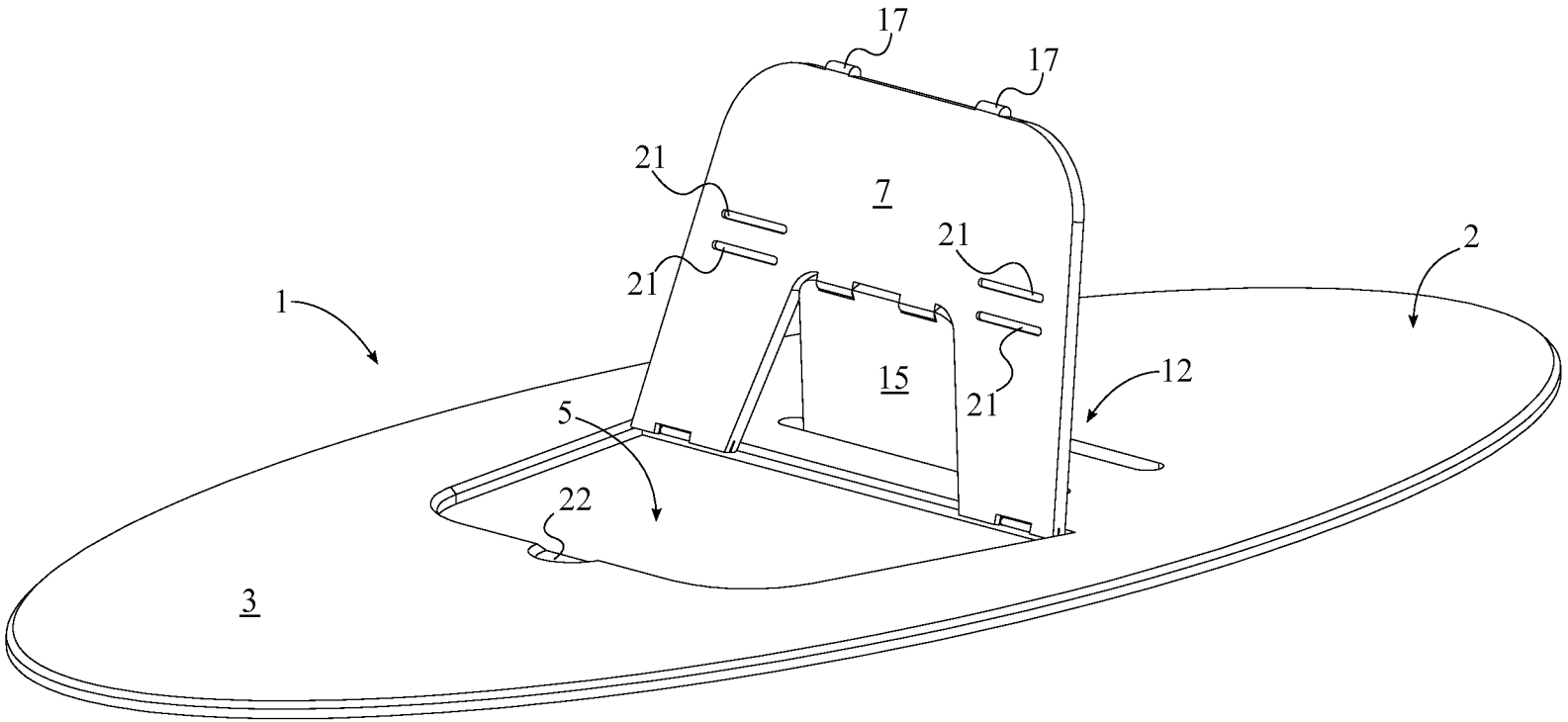
FIG. 1 is a perspective view of the present invention.
Figure 2:
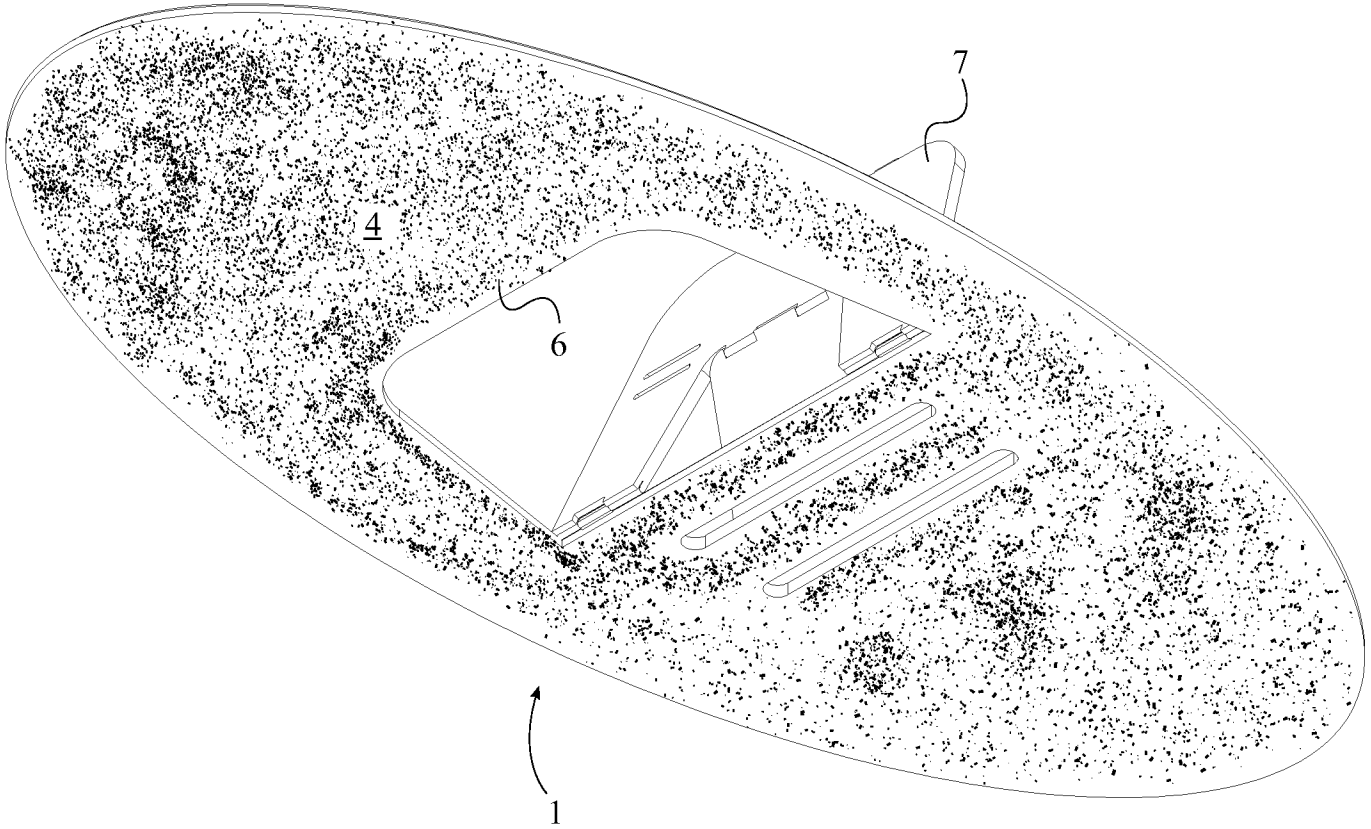
FIG. 2 is a bottom perspective view of the present invention depicting the adhesive.

The seat 7 may be folded within the seat-receiving hole 5 when not in use or folded upwards to act as a back support, allowing the user to sit down and relax or lie on the board and lean into the seat 7. The seat 7 comprises a left leg 8, a right leg 9, a backrest hole 11, and a lumber support 10. The left leg 8 and right leg 9 are positioned opposite to each other across the seat 7. The left leg 8 and right leg 9 are preferably of equal length, width, depth, and design to facilitate symmetrical support to the user. Both the left leg 8 and right leg 9 are hingedly and adjacently connected to the ellipsoid planar body 2 as seen in FIG. 1, and thus allowing the seat 7 to fold down and up relevant to the ellipsoid planar body 2. Additionally, the lumber support 10 is adjacently connected to the right leg 9 and left leg 8, opposite to the ellipsoid planar body 2, bridging and connecting the space between the left leg 8 and right leg 9. The backrest hole 11 is perimetrically delineated by the left leg 8, the right leg 9, and the lumber support 10.

In one embodiment, a physical hinge mechanism is used to connect the left leg 8 and the right leg 9 to the ellipsoid planar body 2. Typical hinge mechanisms include, but are not limited to, piano hinges, case hinges, pivot hinges, butt hinges, flag hinges, and other comparable types. In a different embodiment, the left leg 8 and right leg 9 are hingedly connected to the ellipsoid planar body 2 through a living hinge. More specifically, the connecting region between the ellipsoid planar body 2 and both the left leg 8 and right leg 9 decreases in thickness to such a degree that the material in said region is able to deform to a certain degree and thus acts with similar characteristics as a typical hinge.

Figure 3:
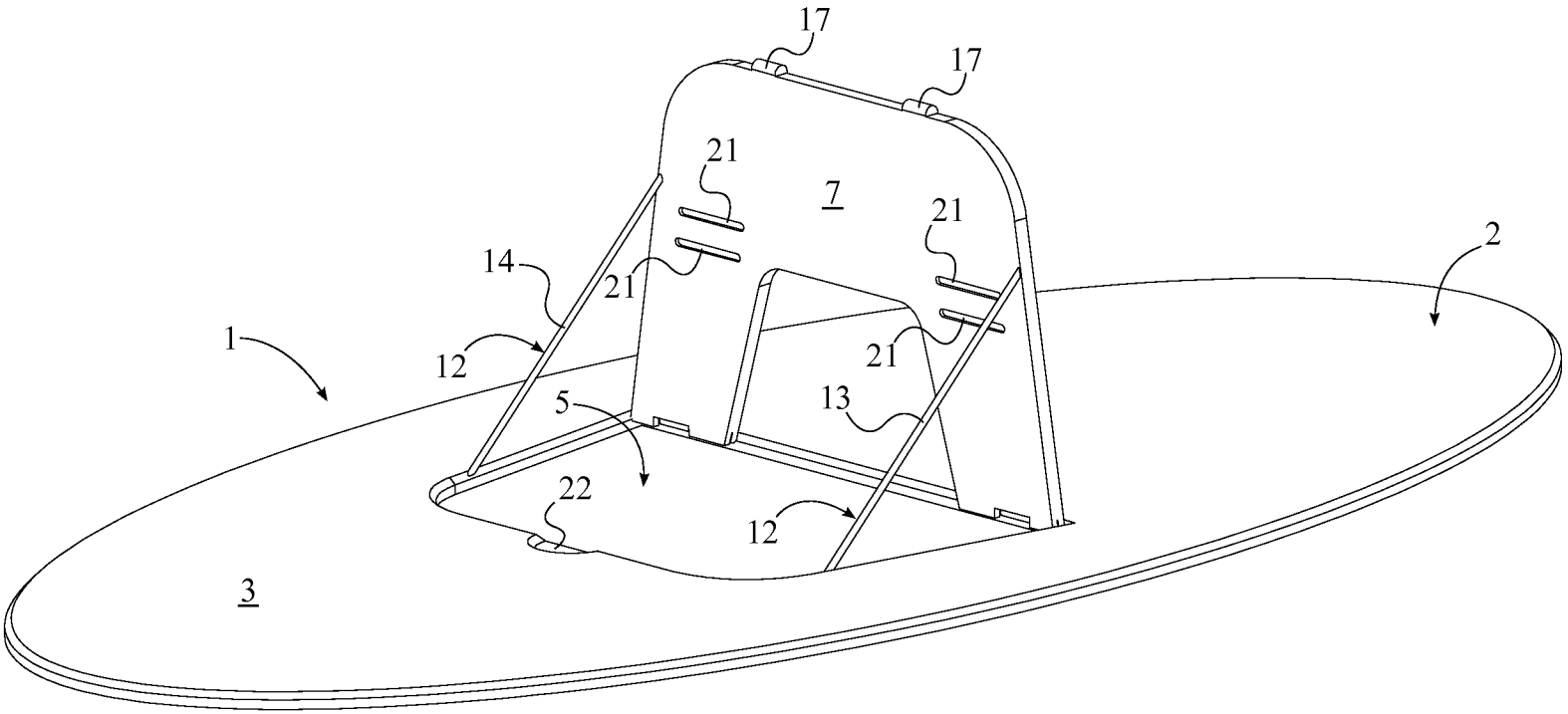
FIG. 3 is a perspective view of the present invention with an alternative bracing mechanism.

The bracing mechanism 12 provides the structural support for the seat 7 in the raised state, allowing the user to comfortably lean back on the seat 7 and relax. In one embodiment, the bracing mechanism 12 comprises a left cord 13 and a right cord 14. The seat 7 is tethered to the ellipsoid planar body 2 by the left cord 13 and the right cord 14. The left cord 13 is positioned adjacent to the seat 7; the right cord 14 is also positioned adjacent to the seat 7, opposite the left cord 13 as seen in FIG. 3. In some embodiment, more than two cords may be utilized to further increase the structural support for the seat 7. When the seat 7 is raised up the left cord 13 and right cord 14 prevent the seat 7 from extending past a certain point; and when the seat 7 is folded down, the left cord 13 and right cord 14 fold down either in between the seat 7 and the paddleboard or lie in the crevices formed between the seat 7 and the ellipsoid planar body 2. The preferred design of the seat 7 contains linear indentations into which the left cord 13 and right cord 14 may fold in when the seat 7 is folded down, flush with the top surface 3.

Figure 4:
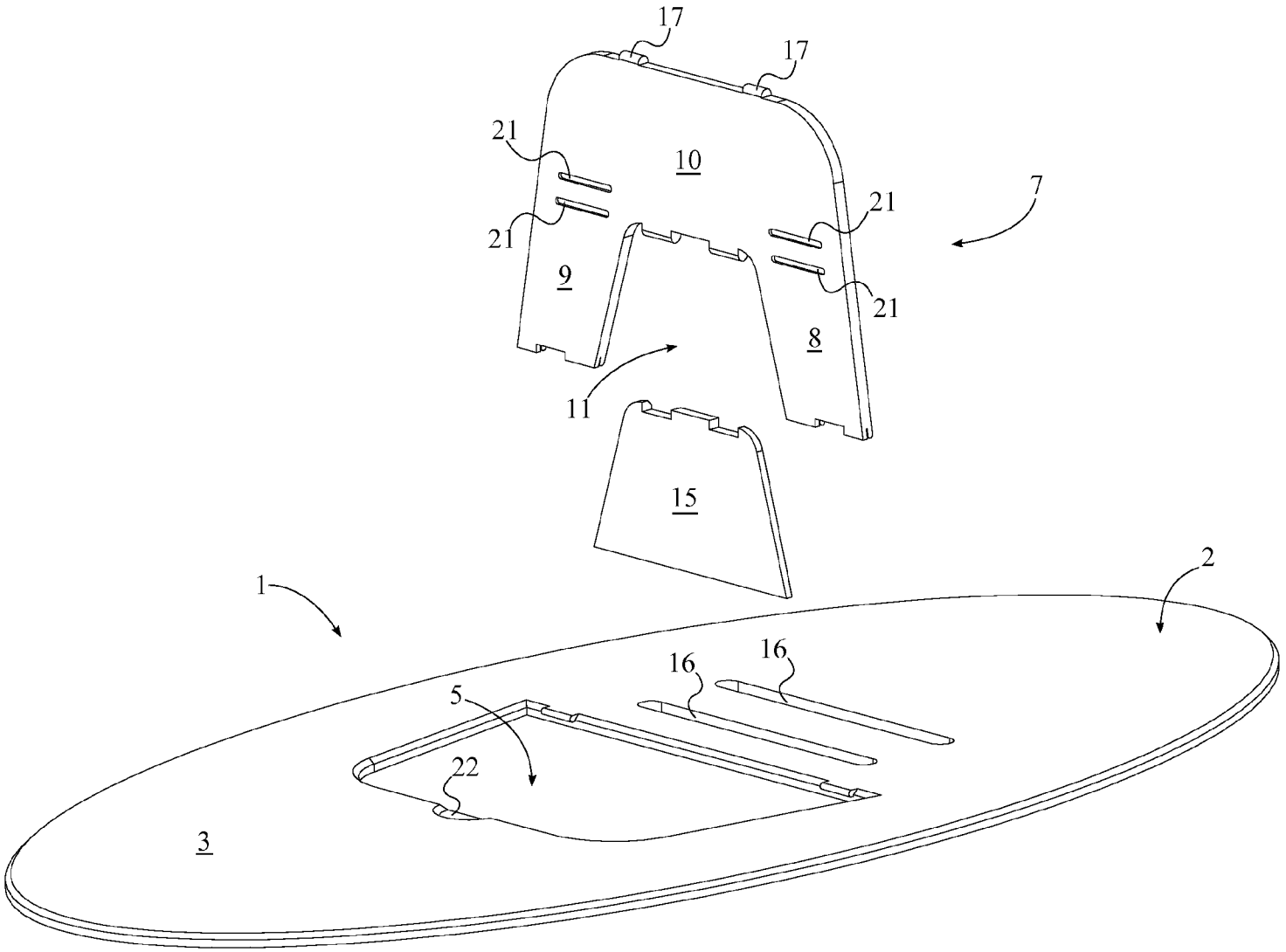
FIG. 4 is an exploded view of the present invention.
Figure 5:
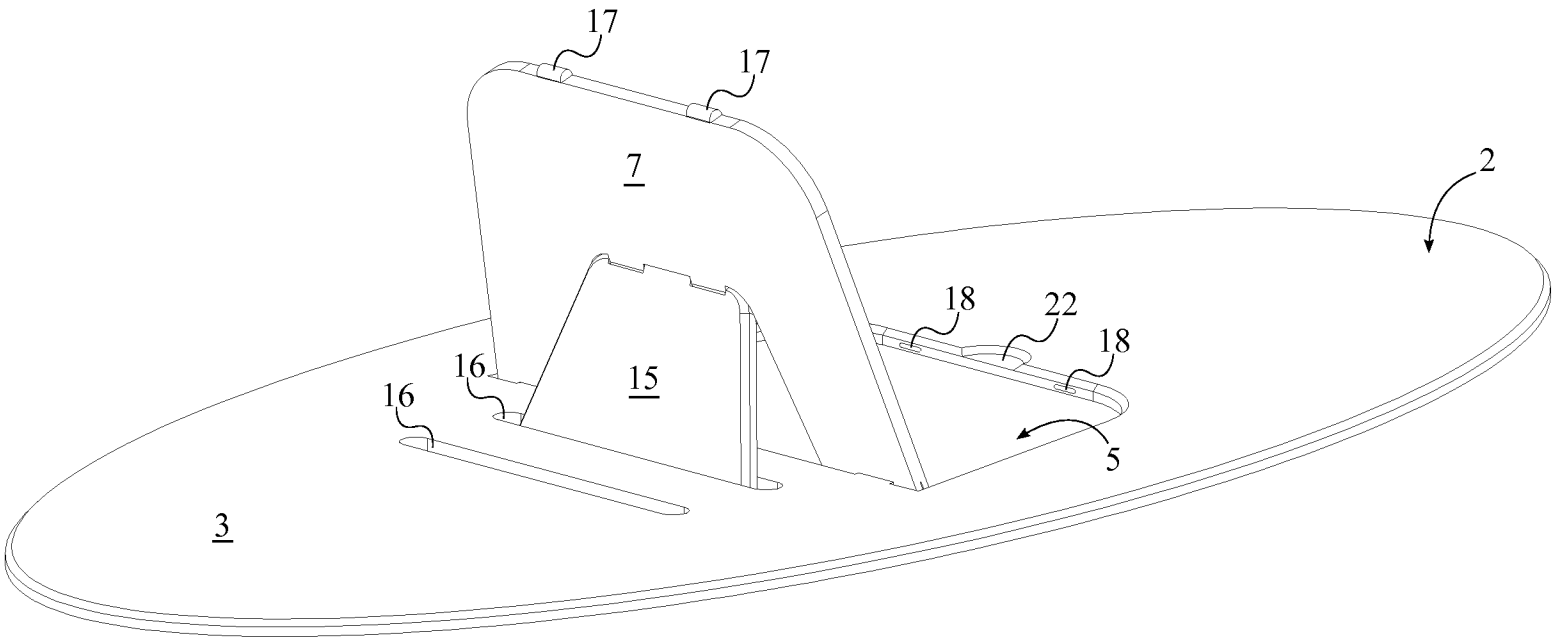
FIG. 5 is a rear perspective view of the present invention.
Figure 6:
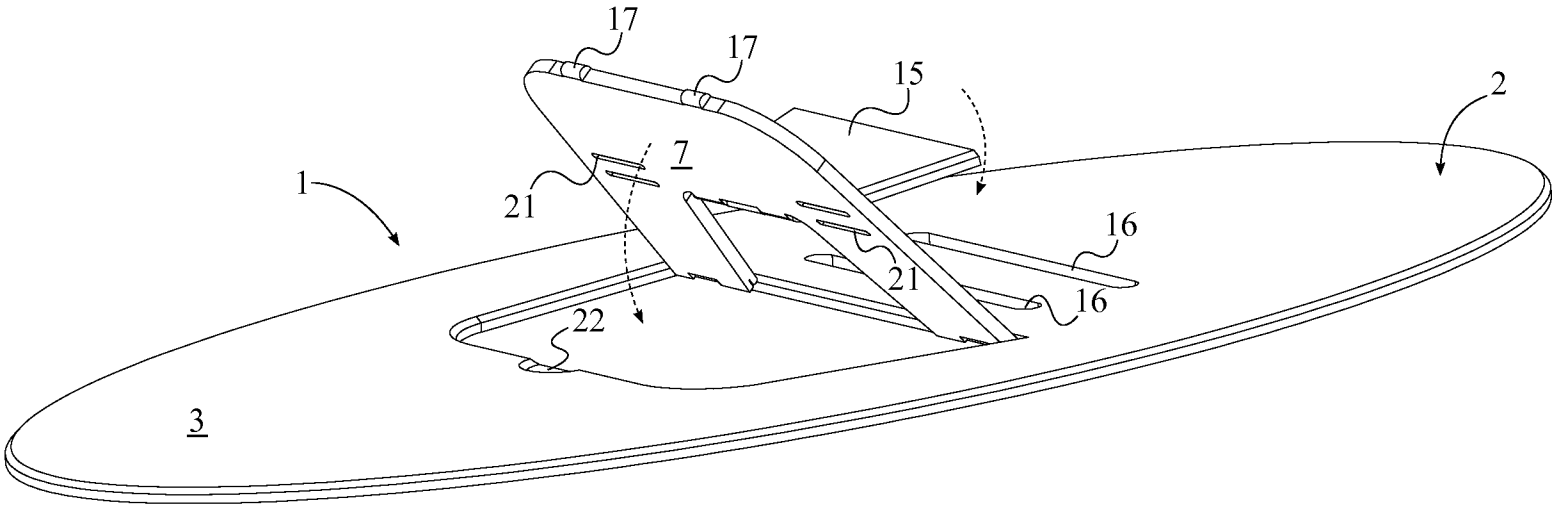
FIG. 6 is a perspective view of the present invention with the arrows depicting how the seat and support strut fold down into the ellipsoid planar body.

In another embodiment, the bracing mechanism 12 comprises a support strut 15 and a series of notches 16. In order to ensure that the seat 7 folds down flush with the ellipsoid planar body 2, the backrest hole 11 is sized to receive the support strut 15 as seen in FIG. 4. The support strut 15 provides the structural support for the seat 7 when the seat 7 is folded up, and as such is hingedly and adjacently connected to the lumber support 10 of the seat 7 as seen in FIG. 5. The support strut 15 is connected to the lumber support 10 at one end and hangs free at the opposite end; the free end may be engaged into one notch within the series of notches 16 to provide the structural support. The series of notches 16 are positioned adjacent to the seat 7, opposite the seat-receiving hole 5; the series of notches 16 traverse through the ellipsoid planar body 2 from the top surface 3 to the bottom surface 4 as seen in FIG. 7. To align within the span of the support strut 15, the series of notches 16 are positioned along the major length of the ellipsoid planar body 2. To set up the structural support for the seat 7, the user simply raises the seat 7 and engages the support strut 15 with one of the series of notches 16; the series of notches 16 is preferably distributed a certain distance apart such that the user may choose which ever setting is preferred. Each notch of the series of notches 16 determines the angle and height at which the seat 7 is held. The closer a notch is to the seat-receiving hole 5, the higher the seat 7 is held and vice versa as can be seen in FIG. 5.

To further ensure that the seat 7 does not interrupt the user's activities when not in use a plurality of locking tabs 17 and a plurality of locking notches 18 are used. The plurality of locking tabs 17 is perimetrically connected around the seat 7. The plurality of locking notches 18 traverses into the ellipsoid planar body 2 from the seat-receiving hole 5, positioned around the seat-receiving hole 5. The plurality of locking notches 18 are distributed about the ellipsoid planar body 2 such that when the seat 7 is positioned within the seat-receiving hole 5 each of the plurality of locking tabs 17 being engaged to a corresponding notch from the plurality of locking notches 18. In order to release the locked seat 7, a finger notch 22 is utilized. The finger notch 22 is positioned adjacent to the set-receiving hole, opposite to the seat 7, and traverses into the ellipsoid planar body 2 from the top surface 3 a certain distance. The finger notch 22 allows the user to initiate the release of the seat 7 by placing a finger under the seat 7 via the finger notch 22 and pulling upwards away from the ellipsoid planar body 2.

Figure 9:
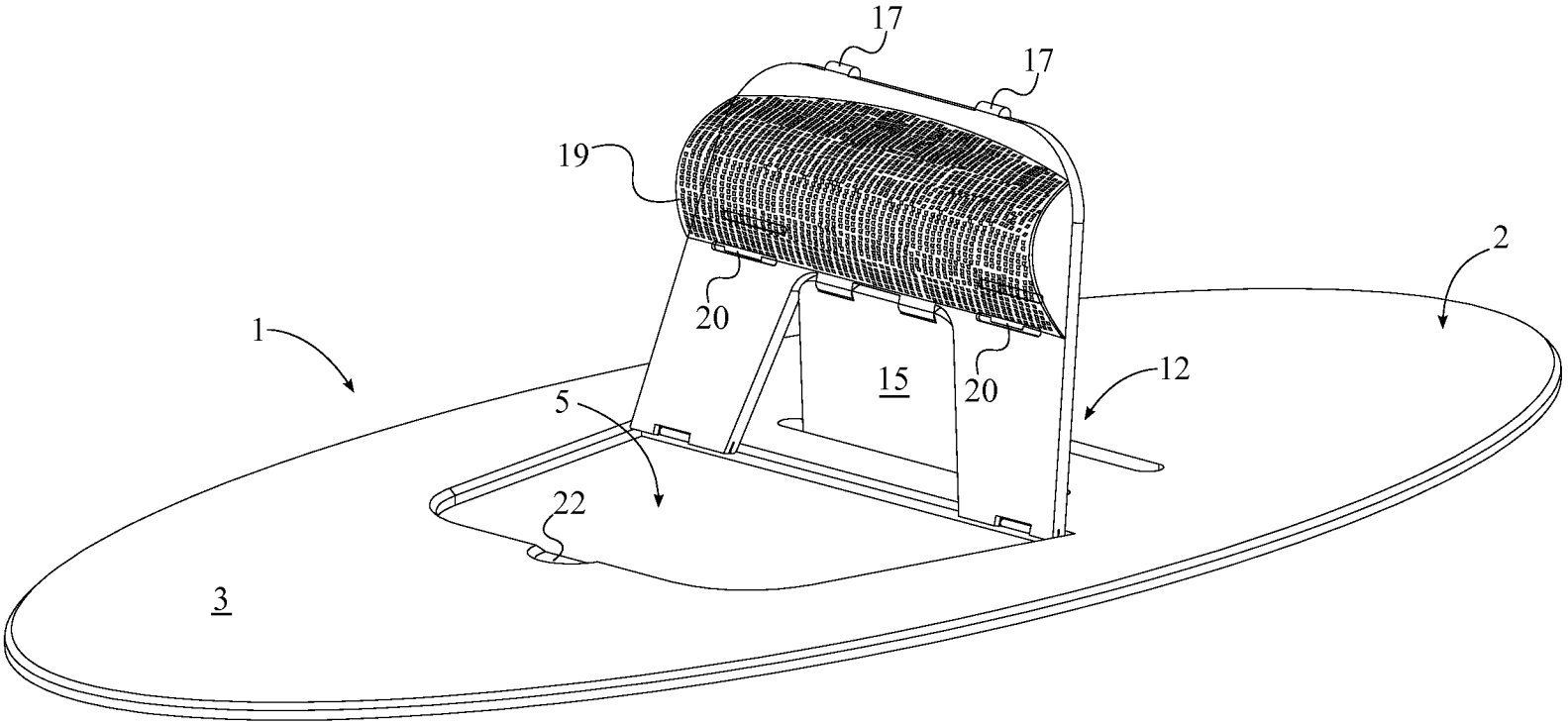
FIG. 9 is a perspective view of the present invention with the flexible cushion panel installed.
Figure 10:
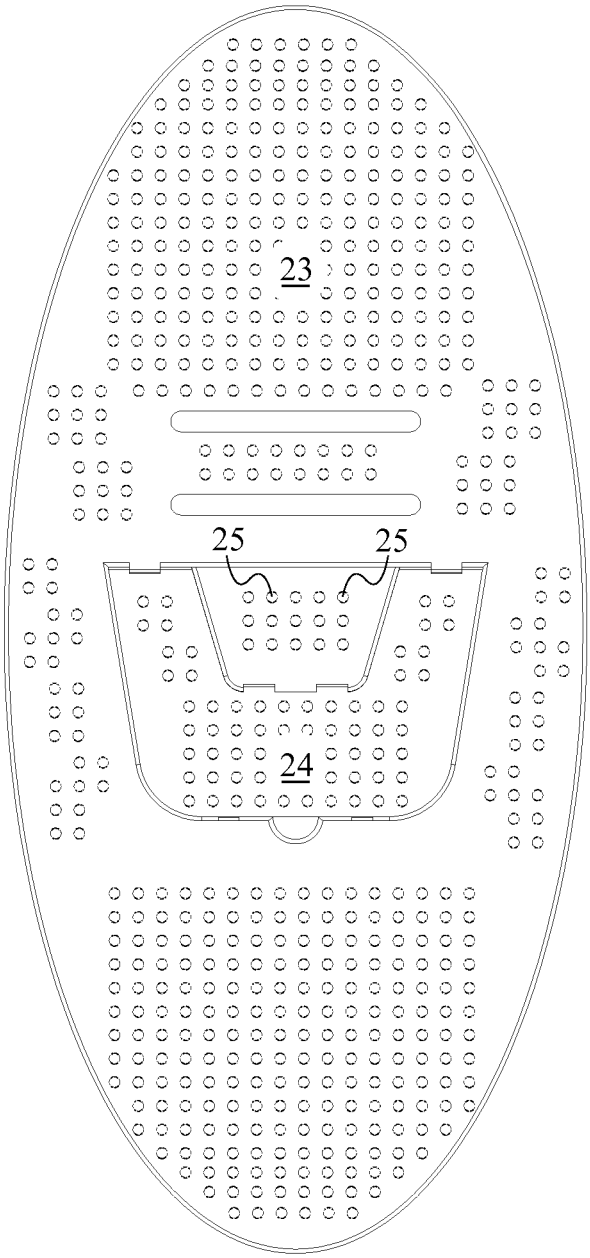
FIG. 10 is a top view of the present invention in the folded down state depicting the plurality of pad traction features, plurality of seat traction features, and plurality of strut traction features.

In one embodiment, a flexible cushioned panel 19 may also be incorporated into the present invention to yield a more ergonomic system. The flexible cushioned panel 19 provides a cushion for the user to lean on instead of just the seat 7 as seen in FIG. 9; the flexible cushioned panel 19 preferably comprises a thin malleable material which thus allows for substantial deformation. The flexible cushioned panel 19 is hingedly and adjacently connected to the seat 7, opposite to the ellipsoid planar body 2, preferably located towards the lumber support 10. Additionally, the flexible cushioned panel 19 is orientated towards the seat-receiving hole 5 such that the user's back directly engages the flexible cushioned panel 19 when the user leans back. In a similar fashion as the support strut 15 design, the flexible cushioned panel 19 may be raised to further increase the comfort of the user through the user a plurality of cushion tabs 20 and plurality of cushion notches 21. The plurality of cushion tabs 20 is adjacently connected to the flexible cushioned panel, opposite the seat 7; the plurality of cushion notches 21 traverses into the seat 7 and orientated towards the seat-receiving hole 5. Additionally, the plurality of cushion notches 21 is evenly distributed across the seat 7. With the plurality of cushion notches 21, the user has a multitude of levels to which the flexible cushioned panel 19 may be raised to. The user simply engages each of the plurality of cushion tabs 20 to a corresponding notch from the plurality of cushion notches 21.

The present invention may also utilize a plurality of pad traction features 23 to increase the control and stability of the user on the paddleboard, similar to traditional traction pads available on the market. The plurality of pad traction features 23 is distributed across the top surface 3. The pad traction features may include, but are not limited to, raised contours, indentations, ribs, ridges, design cutouts, and other similar features. Additionally, the seat 7 may also contain a plurality of seat traction features 24 such that the user has traction all over the present invention. When the seat 7 is positioned within the seat-receiving hole 5 the plurality of seat traction features 24 is distributed across the seat 7, coplanar with the top surface 3 such that user engages said features when standing on top of the seat 7. When the seat 7 is positioned within the seat-receiving hole 5 a multitude of additional traction features become available to the user. A plurality of strut traction features 25 is distributed across the support strut 15 of the bracing mechanism 12, coplanar with the top surface 3.

Although the invention has been explained in relation to its preferred embodiment, it is to be understood that many other possible modifications and variations can be made without departing from the spirit and scope of the invention as hereinafter claimed.

What is claimed is:

1. A traction pad for a stand-up paddle board with an integrated seat comprises:
- a paddleboard mounting pad;
- a seat;
- a bracing mechanism;
- an adhesive;
- the paddleboard mounting pad comprises an ellipsoid planar body and a seat-receiving hole;
- the ellipsoid planar body comprises a top surface and a bottom surface;
- the seat-receiving hole traversing through the ellipsoid planar body from the top surface to the bottom surface;
- the seat being positioned adjacent to the seat-receiving hole;
- the seat being hingedly connected on the ellipsoid planar body;
- the seat being bistably coupled to the ellipsoid planar body by the bracing mechanism; and
- the adhesive being superimposed over the bottom surface.

2. The traction pad for a stand-up paddle board with an integrated seat as claimed in claim 1 comprises:
- the seat comprises a left leg, a right leg, a backrest hole, and a lumber support;
- the left leg and the right leg being positioned opposite to each other across the seat;
- the left leg being hingedly and adjacently connected to the ellipsoid planar body;
- the lumber support being adjacently connected to the left leg, opposite to the ellipsoid planar body;
- the right leg being hingedly and adjacently connected to the ellipsoid planar body;
- the lumber support being adjacently connected to the right leg, opposite to the ellipsoid planar body; and
- the backrest hole being perimetrically delineated by the left leg, the right leg, and the lumber support.

3. The traction pad for a stand-up paddle board with an integrated seat as claimed in claim 1 comprises:
- the bracing mechanism comprises a left cord and a right cord;
- the left cord being positioned adjacent to the seat;
- the right cord being positioned adjacent to the seat, opposite the left cord; and
- the seat being tethered to the ellipsoid planar body by the left cord and the right cord.

4. The traction pad for a stand-up paddle board with an integrated seat as claimed in claim 1 comprises:
- the bracing mechanism comprises a support strut and a series of notches;
- a backrest hole of the seat being sized to receive the support strut;
- the support strut being hingedly and adjacently connect to a lumber support of the seat;
- the series of notches traversing through the ellipsoid planar body from the top surface to the bottom surface;
- the series of notches being positioned adjacent to the seat, opposite to the seat-receiving hole; and
- the series of notches being positioned along a major length of the ellipsoid planar body.

5. The traction pad for a stand-up paddle board with an integrated seat as claimed in claim 4 comprises:
- the support strut being engaged with one of the series of notches.

6. The traction pad for a stand-up paddle board with an integrated seat as claimed in claim 1 comprises:
- a plurality of locking tabs;
- a plurality of locking notches;
- the plurality of locking tabs being perimetrically connected around the seat;
- the plurality of locking notches traversing into the ellipsoid planar body from the seat-receiving hole; and
- the plurality of locking notches being positioned around the seat-receiving hole.

7. The traction pad for a stand-up paddle board with an integrated seat as claimed in claim 6 comprises:
- the seat being positioned within the seat-receiving hole; and
- each of the plurality of locking tabs being engaged to a corresponding notch from the plurality of locking notches.

8. The traction pad for a stand-up paddle board with an integrated seat as claimed in claim 1 comprises:
- a flexible cushioned panel;
- a plurality of cushion tabs;
- a plurality of cushion notches;
- the flexible cushioned panel being hingedly and adjacently connected to the seat, opposite to the ellipsoid planar body;
- the flexible cushioned panel being oriented towards the seat-receiving hole;
- the plurality of cushion tabs being adjacently connected to the flexible cushioned panel, opposite to the seat; and
- the plurality of cushion notches traversing into the seat and being oriented towards the seat-receiving hole.

9. The traction pad for a stand-up paddle board with an integrated seat as claimed in claim 8 comprises:
- the plurality of cushion notches being evenly distributed across the seat; and
- each of the plurality of cushion tabs being engaged to a corresponding notch from the plurality of cushion notches.

10. The traction pad for a stand-up paddle board with an integrated seat as claimed in claim 1 comprises:
- a finger notch;
- the finger notch traversing into the ellipsoid planar body from the top surface; and
- the finger notch being positioned adjacent to the seat-receiving hole, opposite to the seat.

11. The traction pad for a stand-up paddle board with an integrated seat as claimed in claim 1 comprises:
- a plurality of pad traction features; and
- the plurality of pad traction features being distributed across the top surface.

12. The traction pad for a stand-up paddle board with an integrated seat as claimed in claim 1 comprises:
- a plurality of seat traction features;
- the seat being positioned within the seat-receiving hole;
- the plurality of seat traction features being distributed across the seat; and
- the plurality of seat traction features being positioned coplanar with the top surface.

13. The traction pad for a stand-up paddle board with an integrated seat as claimed in claim 1 comprises:

a plurality of strut traction features;

the seat being positioned within the seat-receiving hole;

the plurality of strut traction features being distributed across the support strut of the bracing mechanism; and the plurality of strut traction features being positioned coplanar with the top surface.

14. A traction pad for a stand-up paddle board with an integrated seat comprises:

a paddleboard mounting pad;

a seat;

a bracing mechanism;

an adhesive;

the paddleboard mounting pad comprises an ellipsoid planar body and a seat-receiving hole;

the seat comprises a left leg, a right leg, a backrest hole, and a lumber support;

the ellipsoid planar body comprises a top surface and a bottom surface;

the seat-receiving hole traversing through the ellipsoid planar body from the top surface to the bottom surface;

the seat being positioned adjacent to the seat-receiving hole;

the seat being hingedly connected on the ellipsoid planar body;

the seat being bistably coupled to the ellipsoid planar body by the bracing mechanism;

the adhesive being superimposed over the bottom surface;

the left leg and the right leg being positioned opposite to each other across the seat;

the left leg being hingedly and adjacently connected to the ellipsoid planar body;

the lumber support being adjacently connected to the left leg, opposite to the ellipsoid planar body;

the right leg being hingedly and adjacently connected to the ellipsoid planar body;

the lumber support being adjacently connected to the right leg, opposite to the ellipsoid planar body; and the backrest hole being perimetrically delineated by the left leg, the right leg, and the lumber support.

15. The traction pad for a stand-up paddle board with an integrated seat as claimed in claim 14 comprises:

the bracing mechanism comprises a left cord and a right cord;

the left cord being positioned adjacent to the seat;

the right cord being positioned adjacent to the seat, opposite the left cord; and the seat being tethered to the ellipsoid planar body by the left cord and the right cord.

16. The traction pad for a stand-up paddle board with an integrated seat as claimed in claim 14 comprises:

the bracing mechanism comprises a support strut and a series of notches;

a backrest hole of the seat being sized to receive the support strut;

the support strut being hingedly and adjacently connect to a lumber support of the seat;

the series of notches traversing through the ellipsoid planar body from the top surface to the bottom surface;

the series of notches being positioned adjacent to the seat, opposite to the seat-receiving hole;

the series of notches being positioned along a major length of the ellipsoid planar body; and the support strut being engaged with one of the series of notches.

17. The traction pad for a stand-up paddle board with an integrated seat as claimed in claim 14 comprises:

a plurality of locking tabs;

a plurality of locking notches;

the plurality of locking tabs being perimetrically connected around the seat;

the plurality of locking notches traversing into the ellipsoid planar body from the seat-receiving hole;

the plurality of locking notches being positioned around the seat-receiving hole;

the seat being positioned within the seat-receiving hole; and each of the plurality of locking tabs being engaged to a corresponding notch from the plurality of locking notches.

18. The traction pad for a stand-up paddle board with an integrated seat as claimed in claim 14 comprises:

a flexible cushioned panel;

a plurality of cushion tabs;

a plurality of cushion notches;

the flexible cushioned panel being hingedly and adjacently connected to the seat, opposite to the ellipsoid planar body;

the flexible cushioned panel being oriented towards the seat-receiving hole;

the plurality of cushion tabs being adjacently connected to the flexible cushioned panel, opposite to the seat;

the plurality of cushion notches traversing into the seat and being oriented towards the seat-receiving hole;

the plurality of cushion notches being evenly distributed across the seat; and each of the plurality of cushion tabs being engaged to a corresponding notch from the plurality of cushion notches.

19. The traction pad for a stand-up paddle board with an integrated seat as claimed in claim 14 comprises:

a finger notch;

the finger notch traversing into the ellipsoid planar body from the top surface; and the finger notch being positioned adjacent to the seat-receiving hole, opposite to the seat.

20. The traction pad for a stand-up paddle board with an integrated seat as claimed in claim 14 comprises:

a plurality of pad traction features;

a plurality of seat traction features;

a plurality of strut traction features;

the seat being positioned within the seat-receiving hole;

the plurality of pad traction features being distributed across the top surface;

the plurality of seat traction features being distributed across the seat;

the plurality of seat traction features being positioned coplanar with the top surface;

the plurality of strut traction features being distributed across the support strut of the bracing mechanism; and the plurality of strut traction features being positioned coplanar with the top surface.

* * * * *